US010573434B2

(12) United States Patent
Kobayashi

(10) Patent No.: US 10,573,434 B2
(45) Date of Patent: Feb. 25, 2020

(54) PARALLEL PAIR CABLE

(71) Applicant: SUMITOMO ELECTRIC INDUSTRIES, LTD., Osaka-shi, Osaka (JP)

(72) Inventor: Yuto Kobayashi, Kanuma (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/950,280

(22) Filed: Apr. 11, 2018

(65) Prior Publication Data

US 2018/0301247 A1 Oct. 18, 2018

(30) Foreign Application Priority Data

Apr. 12, 2017 (JP) ..... 2017-079098

(51) Int. Cl.

| | |
|---|---|
| ***H01B 7/00*** | (2006.01) |
| ***H01B 11/18*** | (2006.01) |
| ***H01B 7/02*** | (2006.01) |
| ***H01B 7/08*** | (2006.01) |
| ***H01B 11/20*** | (2006.01) |
| *H01B 11/00* | (2006.01) |
| *H01B 7/282* | (2006.01) |
| *H01B 13/24* | (2006.01) |

(52) U.S. Cl.

CPC ..... *H01B 11/1895* (2013.01); *H01B 7/0225* (2013.01); *H01B 7/0838* (2013.01); *H01B 7/0869* (2013.01); *H01B 11/203* (2013.01); *H01B 7/0275* (2013.01); *H01B 7/2825* (2013.01); *H01B 11/002* (2013.01); *H01B 11/1834* (2013.01); *H01B 13/24* (2013.01)

(58) Field of Classification Search

USPC ..... 174/28, 110 R, 113 R

See application file for complete search history.

(56) References Cited

U.S. PATENT DOCUMENTS 3,032,604 A * 5/1962 Timmons ..... H01B 11/1016 174/107
4,323,721 A * 4/1982 Kincaid ..... H01B 11/06 174/103
4,374,299 A * 2/1983 Kincaid ..... H01B 11/1091 174/105 SC
4,481,379 A * 11/1984 Bolick, Jr. ..... H01B 7/0838 174/117 F (Continued)

FOREIGN PATENT DOCUMENTS

EP 0634755 A1 * 5/1994 ..... H01B 11/10
JP 2015-72772 A 4/2015

*Primary Examiner* — William H. Mayo, III

(74) *Attorney, Agent, or Firm* — Drinker Biddle & Reath LLP

(57) ABSTRACT

A parallel pair cable includes: a pair of insulated wires each of which includes an insulating layer around a conductor; a covering resin layer which is in contact with the pair of insulated wires, and which covers the pair of insulated wires; and a shield layer which is disposed outside the covering resin layer in contact with the covering resin layer, and which includes a metal layer. The pair of insulated wires are in contact with each other and arranged in parallel without being twisted, and the covering resin layer is formed by extrusion of resin.

3 Claims, 8 Drawing Sheets

(56) References Cited

U.S. PATENT DOCUMENTS 4,574,571 A * 3/1986 Thompson ..... H01B 13/2613 57/3
4,596,897 A * 6/1986 Gruhn ..... H01B 7/0861 174/115
4,737,598 A * 4/1988 O'Connor ..... B32B 15/08 174/36
4,830,901 A * 5/1989 Merry ..... B32B 15/08 428/206
4,855,534 A * 8/1989 O'Connor ..... H01B 11/1016 174/36
5,329,064 A * 7/1994 Tash ..... H01B 11/1016 174/106 R
6,444,902 B1 * 9/2002 Tsao ..... H01B 7/0861 174/113 R
6,803,518 B2 * 10/2004 Chang ..... H01B 11/002 174/113 R
6,844,500 B2 * 1/2005 Williams ..... H01B 7/0823 174/110 R
6,977,344 B2 * 12/2005 Tanaka ..... H01B 7/0861 174/117 F
7,999,185 B2 * 8/2011 Cases ..... H01B 11/203 174/113 R
8,674,228 B2 * 3/2014 Dion ..... H01B 13/262 174/105 R
8,981,216 B2 * 3/2015 Grant ..... H01B 11/06 174/113 R
2004/0017264 A1 * 1/2004 Chang ..... H01B 7/0861 333/1
2009/0166082 A1 * 7/2009 Liu ..... H01B 7/0823 174/359
2011/0083877 A1 * 4/2011 Sugiyama ..... H01B 7/0823 174/115
2012/0285723 A1 * 11/2012 Gundel ..... H01B 7/0861 174/113 R
2014/0182890 A1 * 7/2014 Gross ..... H01B 7/00 174/251
2015/0228378 A1 * 8/2015 Guetig ..... H05K 3/3421 174/32

* cited by examiner

PARALLEL PAIR CABLE

CROSS-REFERENCE TO RELATED APPLICATION

This application claims priority from Japanese Patent Application No. 2017-079098, filed on Apr. 12, 2017, the entire subject matter of which is incorporated herein by reference.

TECHNICAL FIELD

The present invention relates to a parallel pair cable.

BACKGROUND

For example, U.S. Pat. No. 8,981,216 discloses a configuration in which twisted wires of a pair of insulated wires are extruded and covered, and a drain wire and a shield tape are wrapped on the outer circumference thereof.

In addition, JP-A-2015-72774 discloses a multicore cable in which a metal tape is longitudinally wrapped on two insulated wires in a state where the insulated wires are arranged in parallel together with drain wires, and the resin is extruded on the outer side of the metal tape to cover it.

In transmission of Scd21, when a positional relationship between the shield layer and the two insulated wires is deviated in a length direction of the cable, a change in impedance of the cable may occur in the length direction. Due to such a change in impedance of the cable, an output amount (Scd21) of a common mode with respect to an input signal of a differential mode may be increased.

SUMMARY

An object of the invention is to provide a parallel pair cable capable of reducing an output amount (Scd21) of a common mode with respect to an input signal of a differential mode in transmission of a differential signal.

According to an aspect of the invention, there is provided a parallel pair cable comprising: a pair of insulated wires each of which includes an insulating layer around a conductor; a covering resin layer which is in contact with the pair of insulated wires, and which covers the pair of insulated wires; and a shield layer which is disposed outside the covering resin layer in contact with the covering resin layer, and which includes a metal layer, wherein the pair of insulated wires are in contact with each other and arranged in parallel without being twisted, and the covering resin layer is formed by extrusion of resin.

DETAILED DESCRIPTION

Figure 1:
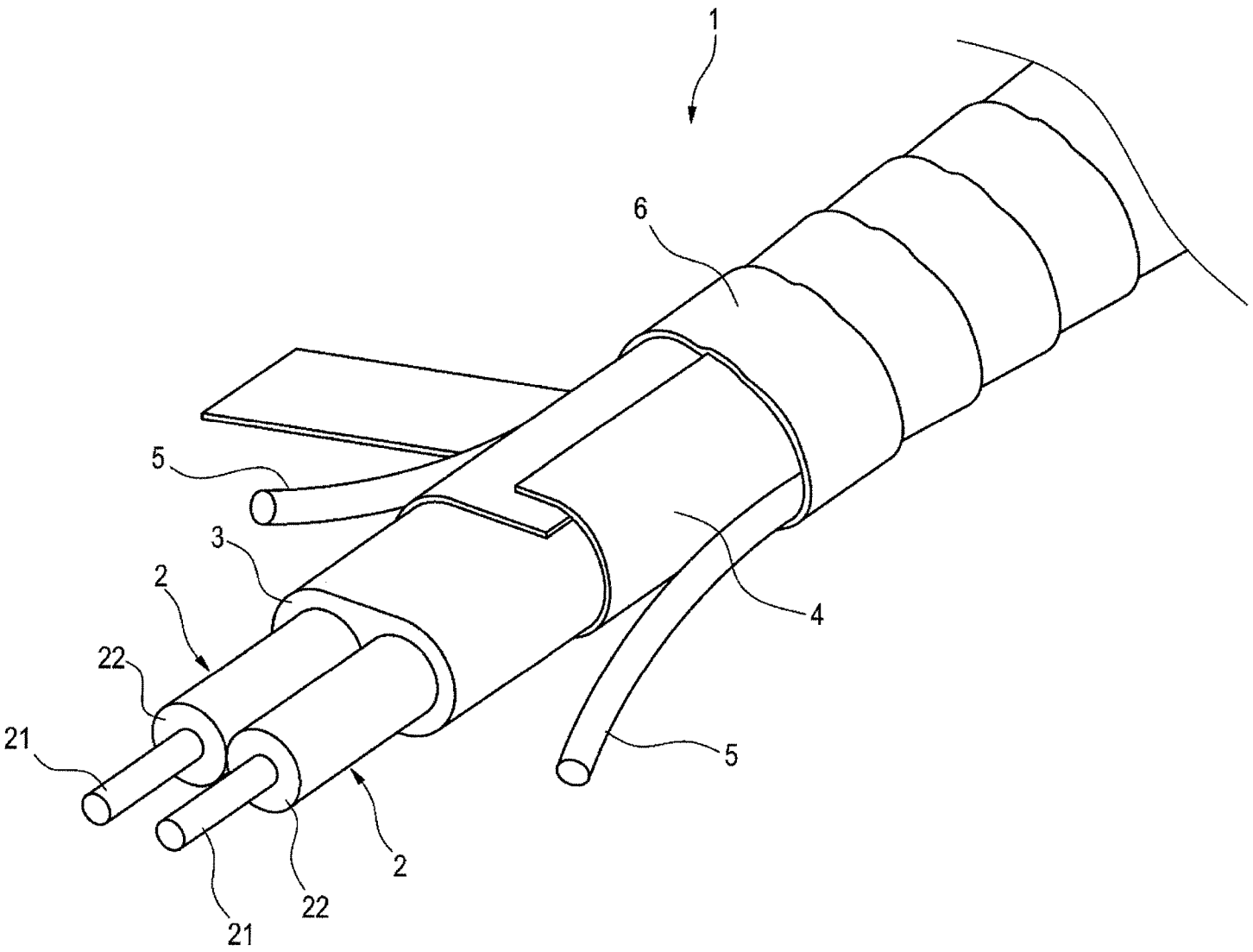
FIG. 1 is a perspective view illustrating a configuration of a parallel pair cable according to a first embodiment.

First, embodiments of the invention will be described with the following lists.

According to an embodiment of the invention, there is provided (1) a parallel pair cable including:

a pair of insulated wires each of which includes an insulating layer around a conductor;

a covering resin layer which is in contact with the pair of insulated wires, and which covers the pair of insulated wires; and a shield layer which is disposed outside the covering resin layer in contact with the covering resin layer, and which includes a metal layer, wherein the pair of insulated wires are in contact with each other and arranged in parallel without being twisted, and the covering resin layer is formed by extrusion of resin.

Since the pair of insulated wires are covered with the covering resin layer, the insulated wires are hardly deviated from each other, and the positional relationship between the insulated wires and the shield layer disposed outside the covering resin layer is stabilized. Accordingly, the impedance of the parallel pair cable hardly changes in the length direction of the cable. Therefore, in the parallel pair cable having the above configuration, it is possible to reduce an output amount (Scd21) on a common mode with respect to an input signal of a differential mode in transmission of a differential signal.

(2) The covering resin layer covers the insulating layers of the pair of insulated wires without a gap.

Since the pair of insulated wires are covered with the covering resin layer without a gap, the insulated wires are more hardly deviated from each other.

(3) A first resin forming the covering resin layer is different in property from a second resin forming the insulating layers of the pair of insulated wires, the first resin has higher mechanical strength than the second resin, and the second resin has lower dielectric constant than the first resin.

The resin of the covering resin layer has high mechanical strength, and thus the insulated wires provided therein can be easily protected. The resin of the insulating layers of the insulated wires has low dielectric constant, and thus the electrical characteristics between the conductors of the insulated wires can be easily adjusted to a desired value. In addition, the insulating layers between the conductors of the insulated wires can be thinned.

(4) The parallel pair cable further includes a drain wire which is disposed so as to be in electrical contact with the metal layer of the shield layer.

The drain wire 5 is connected to an external ground terminal, and thus the shield layer of the parallel pair cable can be easily grounded.

(5) The drain wire is located outside the shield layer.

The shield layer can be brought into close contact with the covering resin layer, and thereby stabilizing the impedance.

(6) The parallel pair cable further includes an insulating jacket layer which is provided outside the shield layer and the drain wire.

The insulating jacket layer is provided outside the shield layer and the drain wire, whereby it is possible to insulate the shield layer, to increase the mechanical strength of the cable, and to achieve the cable with water resistance.

Embodiments

A parallel pair cable according to embodiments of the invention will be described in detail with reference to the following drawings.

The invention is not limited to these embodiments, but is indicated by the claims and is intended to include meanings equivalent to the claims and all modifications within the scope of the claims.

First Embodiment

Figure 2:
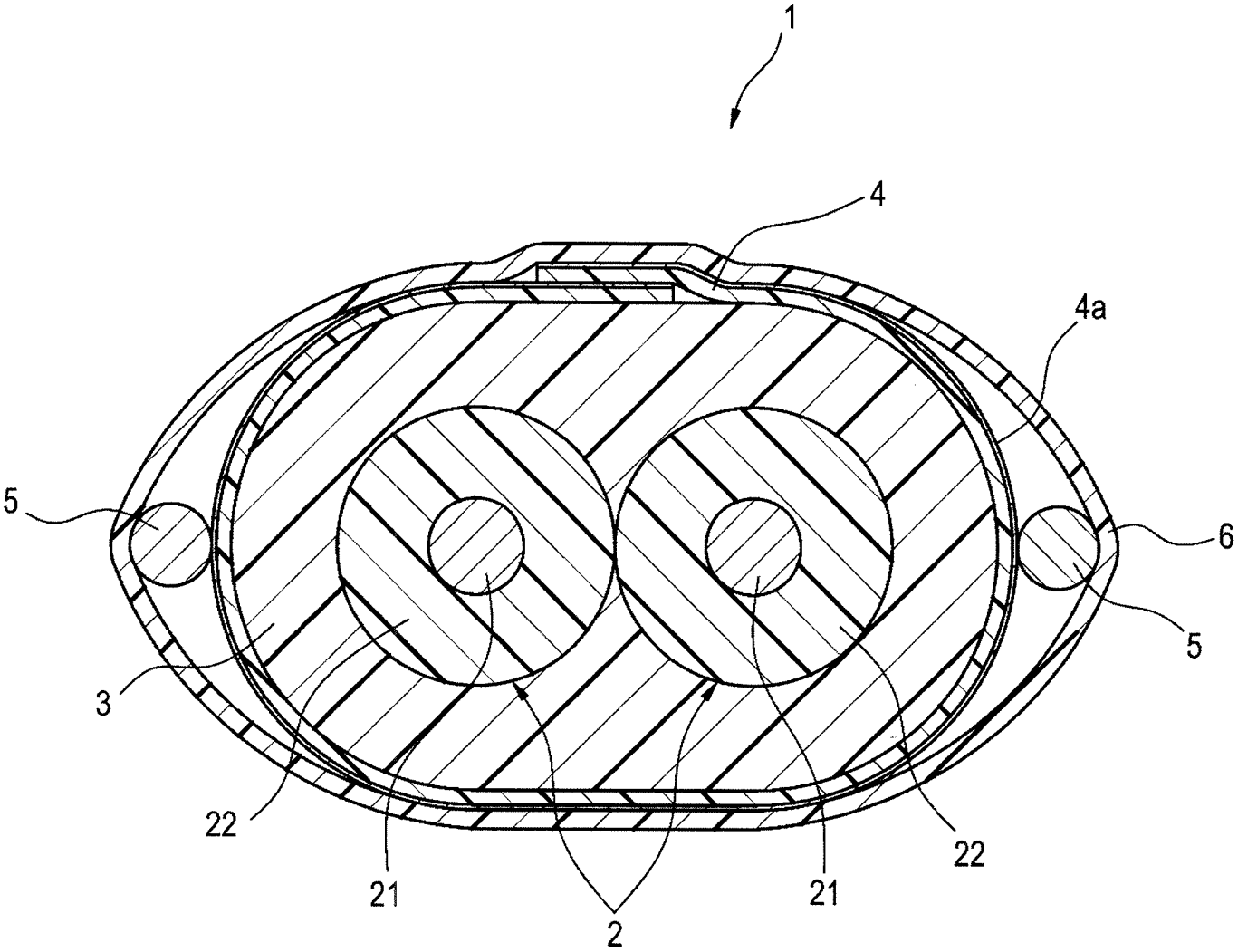
FIG. 2 is a cross-sectional view orthogonal to a length direction of the parallel pair cable illustrated in FIG. 1.

As illustrated in FIGS. 1 and 2, a parallel pair cable 1 includes a pair of insulated wires 2 which are in contact with each other and arranged in parallel without being twisted, and a covering resin layer 3 which covers the pair of insulated wires 2. The covering resin layer 3 is in contact with the insulated wires 2.

The parallel pair cable 1 further includes a shield layer 4 on the outside of the covering resin layer 3, drain wires 5 disposed outside the shield layer 4, and a jacket layer 6 provided around the shield layer 4 and the drain wires 5.

The insulated wire 2 includes a signal conductor (conductor) 21 provided at the center, and an insulating layer 22 covers the circumference of the signal conductor 21. The signal conductor 21 is, for example, a single wire or a twisted wire, formed of a conductor such as copper or aluminum, a conductor plated with tin or silver, or the like. The insulating layer 22 is formed of a low-density polyethylene (LDPE) resin or the like.

The dimension of the conductor used for the signal conductor 21 is, for example, AWG38 to AWG22 according to the American Wire Gauge (AWG) standard. The insulating layer 22 is formed of polyethylene (PE), ethylene vinyl acetate copolymer (EVA), fluororesin and the like. The outer diameter of the insulated wire 2 is, for example, about 0.3 mm to 3.0 mm, and is, for example, about 0.9 mm when the signal conductor 21 of AWG30 is used.

The covering resin layer 3 is formed such that the pair of insulated wires 2 are integrally covered by using a pressure set up method, for example. In the pressure set up method, for example, the insulating layer 22 of the insulated wires 2 and the molten HDPE (high-density polyethylene) resin to be the covering resin layer 3 are pressed to be in contact with each other in a mold (not shown), and are extruded from the mold, thereby performing molding. As illustrated in FIG. 2, the pair of insulated wires 2 are brought into close contact with the covering resin layer 3 without a gap.

A resin (hereinafter, also referred to as a second resin) constituting the covering resin layer 3 can be a resin different from a resin (hereinafter, also referred to as a first resin) constituting the insulating layer 22. For example, the above-described second resin can be a resin different from the first resin in electrical characteristics and mechanical strength.

For example, the first resin may have higher mechanical strength than the second resin, and the second resin may have lower dielectric constant than the first resin. For example, the first resin is set to a low-density polyethylene (LDPE) resin excellent in electrical characteristics, and the second resin is set to a high-density polyethylene (HDPE) resin with excellent mechanical strength. In this case, the second resin (resin of the covering resin layer 3) has high mechanical strength, and thus the insulated wires 2 provided therein can be easily protected. In addition, the first resin (resin of the insulating layer 22) has low dielectric constant, and thus the electrical characteristics between the signal conductors 21 of the pair of insulated wires 2 can be easily adjusted to a desired value.

On the other hand, as the first resin and the second resin, a resin other than the above-described resin may be used. The electrical characteristics, mechanical characteristics, outer diameters, and the like of the parallel pair cable 1 can be adjusted to desired values by appropriately adjusting the material of the first resin and the second resin.

Further, the first resin and the second resin may be the same type of resin. In this case, since a single resin is used, it is possible to reduce cost compared to a case where a plurality of types of resins are respectively used.

The shield layer 4 is formed of a resin tape with a metal layer in which a metal layer 4*a* such as copper or aluminum is adhered or evaporated to a resin tape such as PET.

The thickness of the shield layer 4 is, for example, about 10 μm to 50 μm, and the thickness of the metal layer 4*a* is, for example, about 0.1 μm to 20 μm. Moreover, as the shield layer 4, a metal tape formed of a metal on both sides or a resin tape with a metal layer in which a metal tape is stuck or deposited on both sides of the resin tape may be used.

For example, the shield layer 4 is longitudinally wrapped on the outer side of the covering resin layer 3. On the longitudinally wrapped shield layer 4, an adhesive is preferably attached to the overlapping portion. The overlapping portion is fixed with the adhesive, and thus the wrapped shape is maintained. Further, the shield layer 4 is wrapped such that the metal layer 4*a* is disposed on the outer side.

In the example illustrated in FIGS. 1 and 2, the respective drain wires 5 are longitudinally wrapped on the left and right lateral side surfaces in the direction (the lateral direction in FIG. 2) orthogonal to the length direction of the parallel pair cable 1. The locations where the drain wires 5 are longitudinally wrapped may be places other than the lateral side surfaces. In the cross-sectional view illustrated in FIG. 2, it is preferable to arrange the two drain wires 5 at points symmetrical about the cable center. In addition, as in the example illustrated in FIGS. 1 and 2, the number of the drain wires 5 is not limited to two, and may be one or three or more. The drain wires 5 are provided to be in electrical contact with the metal layer 4*a*. In the example illustrated in FIGS. 1 and 2, the drain wires 5 are disposed on the outer side of the shield layer 4. In a case where the drain wires 5 are disposed inside the shield layer 4, the metal layer 4*a* is disposed inside the shield layer 4. The outer diameter of the drain wire 5 is about 0.08 mm to 0.8 mm, for example.

The drain wires 5 are connected to a ground terminal or the like outside the parallel pair cable 1, and thus the shield layer of the parallel pair cable 1 can be easily grounded. In addition, in a case where the drain wires are disposed on the outer side of the shield layer 4, the shield layer 4 can be brought into close contact with the covering resin layer 3, and thereby stabilizing the impedance of the parallel pair cable 1 in the length direction of the cable.

The jacket layer 6 is, for example, an insulating layer formed by wrapping a resin tape such as PET or PVC. The jacket layer 6 may be formed of a plurality of layers. Further, the jacket layer 6 may be formed by extrusion molding a thermoplastic resin such as polyethylene, polyvinyl chloride, and fluororesin, According to the parallel pair cable 1 of the first embodiment, since the pair of insulated wires 2 are covered with the covering resin layer 3, the insulated wires 2 are hardly deviated, and the positional relationship between the shield layer 4 disposed on the outside of the covering resin layer 3 is stabilized. Therefore, the parallel pair cable 1 can reduce an output amount in a common mode (Scd21) with respect to an input signal in a differential mode in transmission of a differential signal.

By using the pressure set up method, the pair of insulated wires 2 are brought into close contact with the covering resin layer 3 without a gap, and thus the insulated wires are further hardly deviated with each other.

The coupled cable such as the parallel pair cable 1 has a characteristic impedance determined based on the impedance Z1 between a pair of signal wires (signal conductors 21) and the impedances Z2 and Z3 with respect to the ground (shield layer 4) of each signal wire (signal conductor 21). That is, by adjusting the above-described impedances Z1, Z2, and Z3, it is possible to set the characteristic impedance of the parallel pair cable 1 to a predetermined value (for example, 100Ω). In the present embodiment, since the covering resin layer 3 is provided between the insulating layer 22 of the insulated wire 2 and the shield layer 4, it is possible to increase the impedances Z2 and Z3 between the signal conductor 21 and the shield layer 4 by compensating (for example, thickening) with the covering resin layer 3 even if the insulating layer 22 is thinned. If the insulating layers 22 are thinned, since the signal conductors 21 can be brought close to each other, electromagnetic coupling (coupling) between the signal conductors 21 can be strengthened, and the transmission characteristics can be improved.

Further, similarly to the cable disclosed in U.S. Pat. No. 8,981,216, the parallel pair cable 1 is, for example, superior to the cable, in which a pair of insulated wires are twisted, in high frequency transmission characteristics in which there is less loss of high frequency signals.

In addition, in a case where the insulating jacket layer 6 is provided on the outer side of the shield layer 4 and the drain wires 5, it is possible to insulate the shield layer 4, to increase the mechanical strength of the cable, and to achieve the parallel pair cable 1 with water resistance.

Second Embodiment

Figure 3:
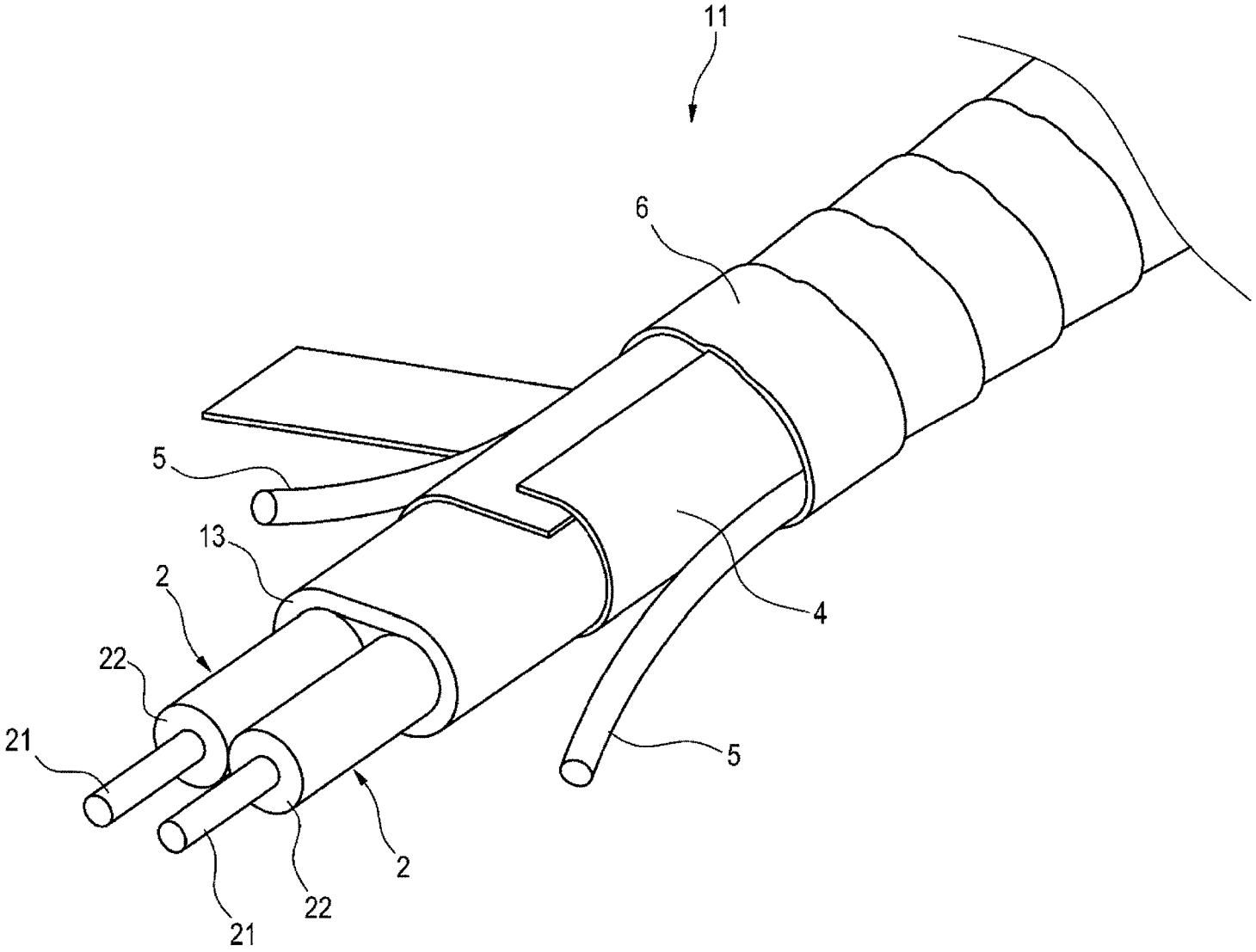
FIG. 3 is a perspective view illustrating a configuration of a parallel pair cable according to a second embodiment.
Figure 4:
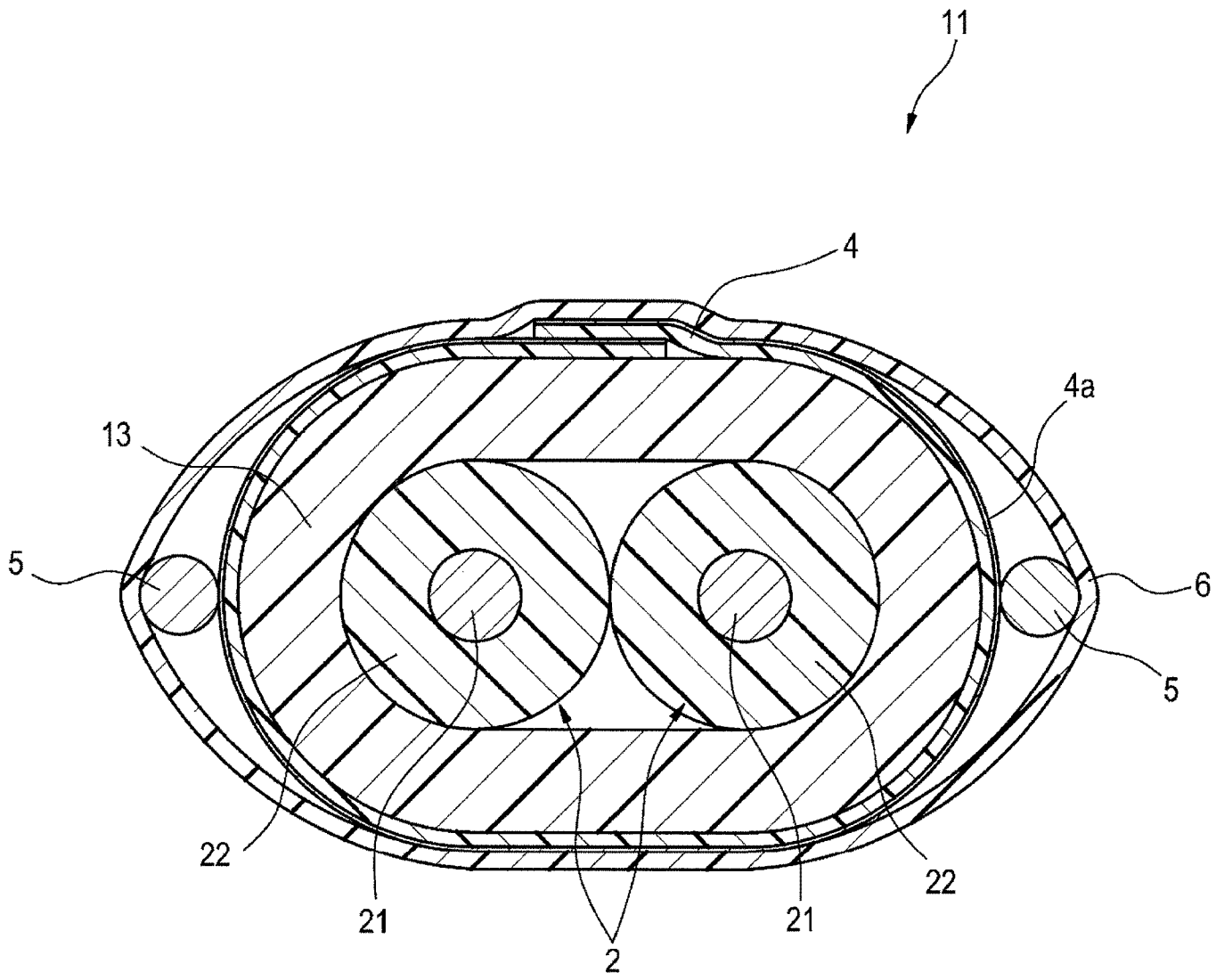
FIG. 4 is a cross-sectional view orthogonal to a length direction of the parallel pair cable illustrated in FIG. 3.

As illustrated in FIGS. 3 and 4, a parallel pair cable 11 includes a pair of insulated wires 2 which are in contact with each other and arranged in parallel without being twisted, and a covering resin layer 13 which covers the pair of insulated wires 2.

Further, the parallel pair cable 11 includes a shield layer 4 on the outer side of the covering resin layer 13, drain wires 5 disposed on the outer side of the shield layer 4, and a jacket layer 6 provided around the shield layer 4 and the drain wires 5.

Descriptions on the portions with the same reference numerals as those in the above-described first embodiment are omitted in order to avoid repeated descriptions on the same configurations.

The covering resin layer 13 of the second embodiment is formed such that the pair of insulated wires 2 are integrally covered using a tubing set up method, for example. In the tubing set up method, for example, the molten HDPE (high-density polyethylene) resin to be the covering resin layer 13 is reduced in diameter after being extruded from a mold (not shown), and is brought into contact with the insulating layers 22 of the insulated wires 2 outside the mold, thereby performing molding. By performing molding with such a tubing set up method, the pair of insulated wires 2 are brought into close contact with the covering resin layer. However, as illustrated in FIG. 4, a gap is generated at a part between the pair of insulated wires 2 and the covering resin layer 13.

A resin constituting the covering resin layer 13 can be set a resin different from a resin constituting the insulating layer 22 similarly to the covering resin layer 3 of the first embodiment, and combinations thereof and the like can be made the same as in the first embodiment.

As the first embodiment, the resin constituting the covering resin layer 13 and the resin constituting the insulating layer 22 may be the same type of resin.

According to the parallel pair cable 11 of the second embodiment, the identical effects to the first embodiment can be obtained.

EXAMPLES

Analysis results of Scd21 and Sdd21 in a parallel pair cable according to Examples and Comparative Example will be described.

Scd21 indicates a conversion amount from an operation mode to a common mode in a range from a port 1 (one signal conductor 21) to a port 2 (the other signal conductor 21), and is one of an S-parameter of a mix mode.

Sdd21 is an output amount in a case where both ends of the port 1 (one signal conductor 21) and the port 2 (the other signal conductor 21) are in a differential mode (when used in normal balanced transmission).

Example 1

A parallel pair cable 1 according to Example 1 has the configuration illustrated in FIGS. 1 and 2 according to the first embodiment, and is set as follows.

Two insulated wires 2 which have a diameter of 0.96 mm are arranged in parallel, the insulated wire including a signal conductor 21 of AWG28 (sectional area of a conductor is 0.089 $mm^2$). The thickness of an insulating layer 22 of the insulated wire 2 and the thickness of a covering resin layer 3 are set such that the characteristic impedance of the parallel pair cable 1 becomes 100Ω.

A shield layer 4 provided with a copper metal layer 4*a* is longitudinally wrapped around the covering resin layer 3 such that the metal layer 4*a* is disposed on the outer side. An insulating tape is wrapped spirally on the outer side of the shield layer 4 and the drain wire 5, thereby forming a jacket layer 6.

A simulation of transmitting high frequency signals in a range from 1 GHz to 20 GHz is performed on the parallel pair cable 1 having the above-described configuration, and Scd21 and Sdd21 are obtained.

Example 2

Figure 5:
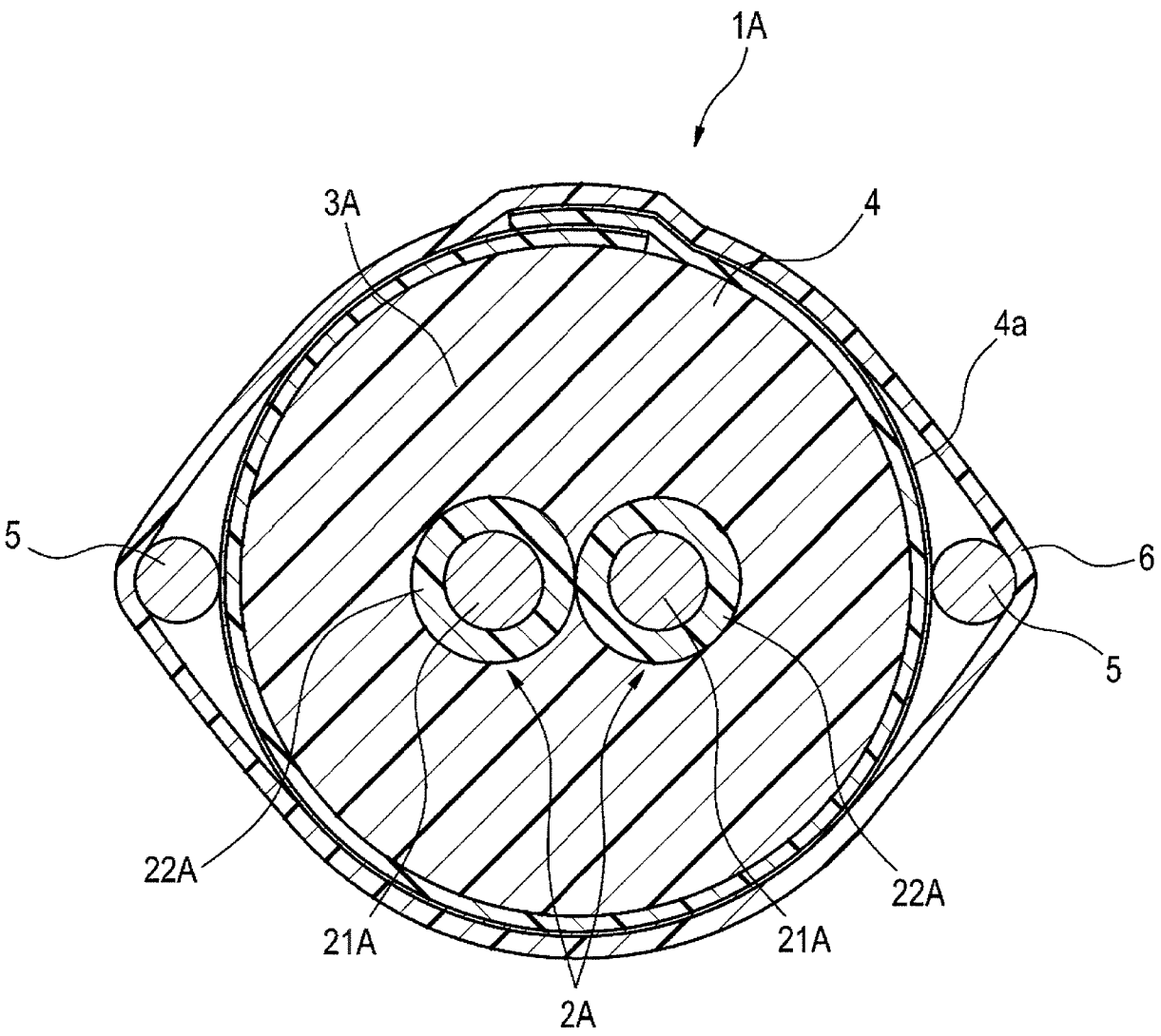
FIG. 5 is a cross-sectional view orthogonal to a length direction of a parallel pair cable according to Example 2.

A parallel pair cable 1A according to Example 2 has a configuration (shown in FIG. 5) in which the distance between the signal conductors is made 40% closer in the parallel pair cable 1 of Example 1.

Signal conductors 21A of insulated wires 2A have the same size as those in Example 1. The thickness of the insulating layer 22A and the thickness of a covering resin layer 3A are set such that the characteristic impedance of the parallel pair cable 1A becomes 100Ω. Other configurations are the same as those in Example 1.

A simulation of transmitting high frequency signals in a range from 1 GHz to 20 GHz is performed on the parallel pair cable 1A having the above-described configuration, and Scd21 and Sdd21 are obtained.

Comparative Example

Figure 6:
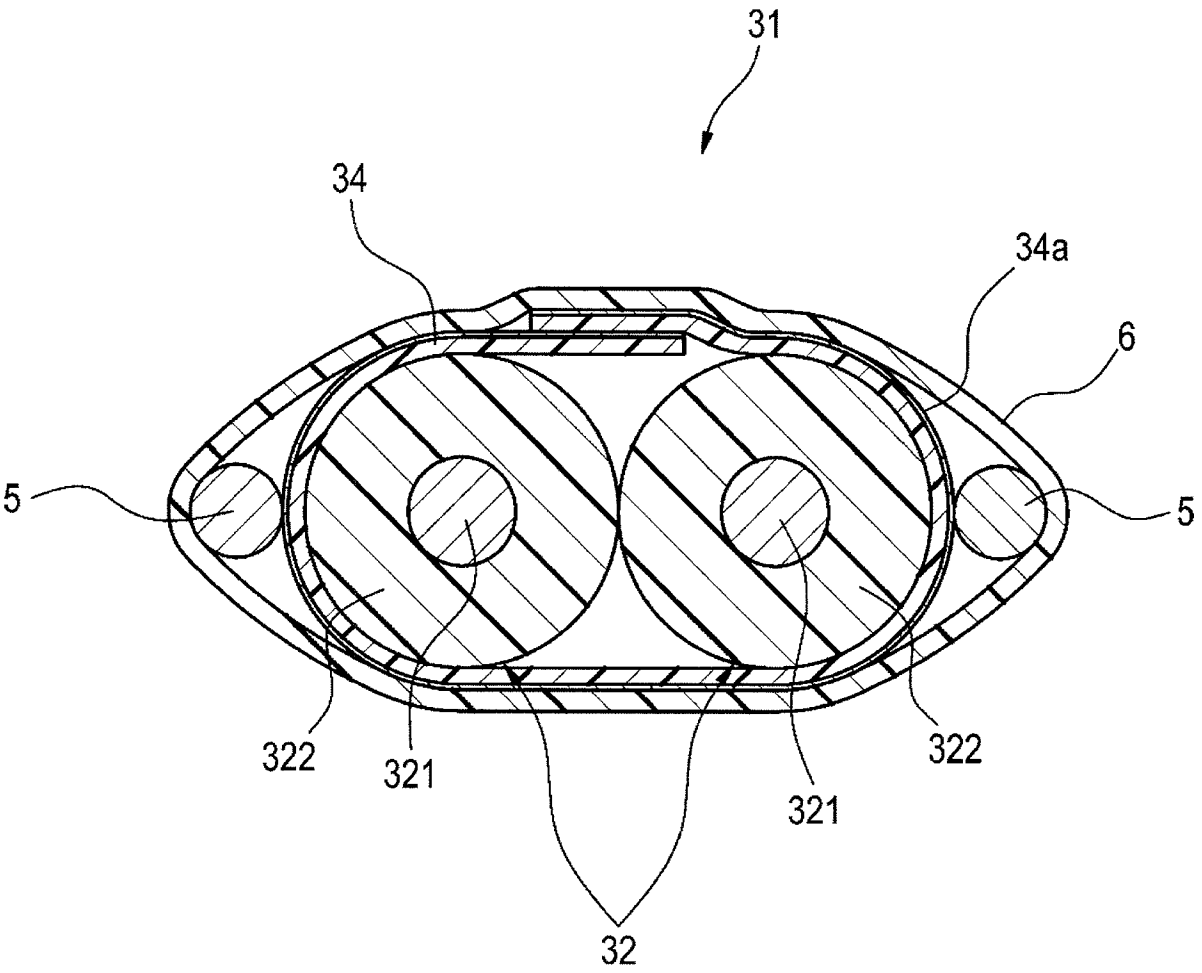
FIG. 6 is a cross-sectional view orthogonal to a length direction of the parallel pair cable according to Comparative Example.

As illustrated in FIG. 6, a parallel pair cable 31 according to Comparative Example has a configuration in which a covering resin layer is not included. For this reason, a direct shield layer 34 is longitudinally wrapped around an insulating layer 322 of insulated wires 32 (in the drawing, the reference numeral 34*a* indicates a metal layer). The configurations of the drain wire 5 and the jacket layer 6 are the same as those in Example 1. Signal conductors 321 of the insulated wires 32 have the same size as those in Example 1.

A simulation of transmitting high frequency signals in a range from 1 GHz to 20 GHz is performed on the parallel pair cable 31 having the above-described configuration, and Scd21 and Sdd21 are obtained.

Figure 7:
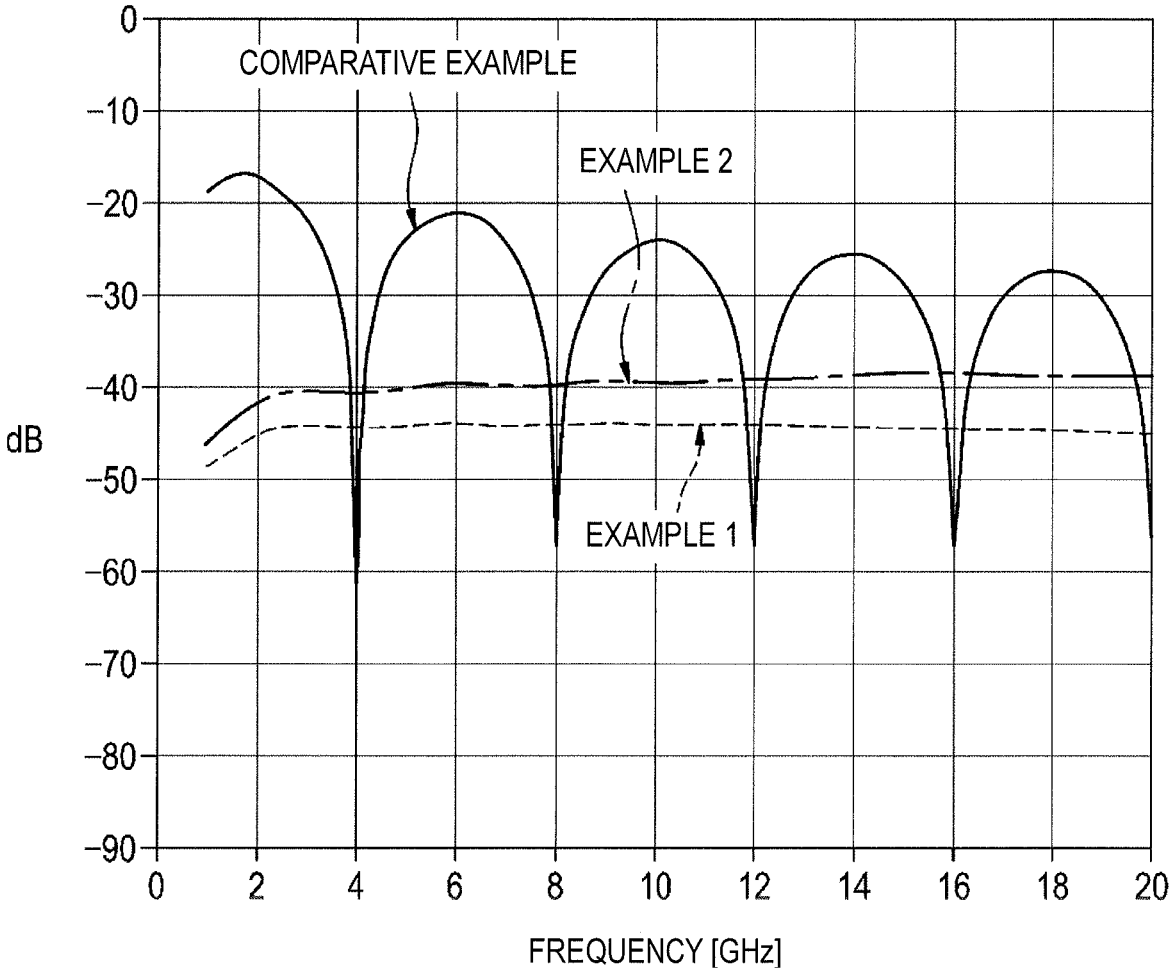
FIG. 7 is a graph showing simulation results (Scd21) of Examples 1 and 2, and Comparative example.
Figure 8:
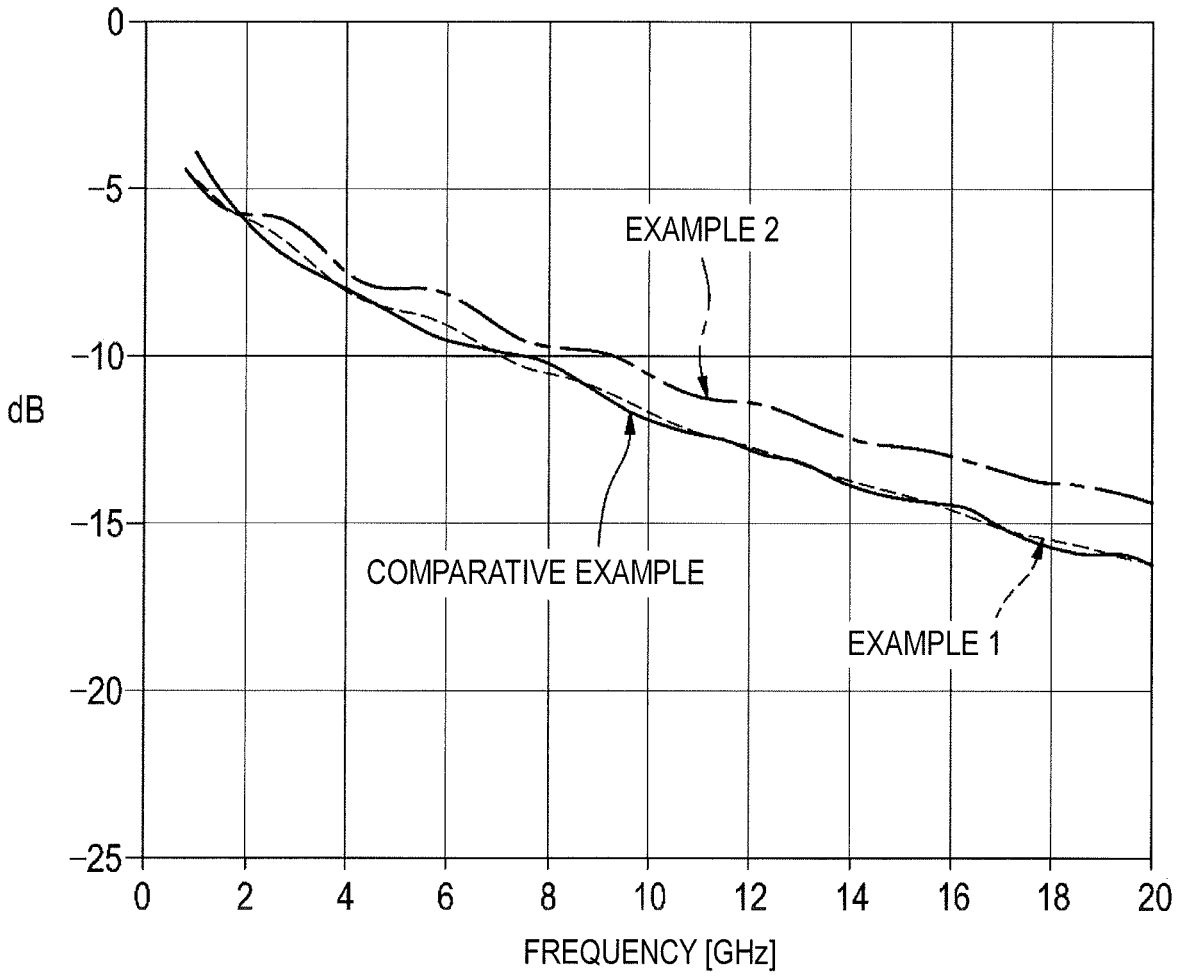
FIG. 8 is a graph showing simulation results (Sdd21) of Examples 1 and 2, and Comparative example.

The results of frequency characteristics of Scd21 and Sdd21 obtained from the simulations in the above Examples 1 and 2 and Comparative Example are compared to each other (see FIGS. 7 and 8).

As illustrated in FIG. 7, regarding Scd21, preferred results are obtained in Examples 1 and 2 as compared to Comparative Example. Therefore, regarding Scd21, Examples 1 and 2 are preferable than Comparative Example.

As the above results, it is possible to reduce Scd21 (to improve the transmission characteristics) in the parallel pair cables 1 and 1A as compared to the parallel pair cable having a configuration in which the covering resin layer is not included.

Further, if the distance between the signal conductors is made closer as the parallel pair cable 1A, electromagnetic coupling (coupling) between the signal conductors can be strengthened, and as illustrated in FIGS. 7 and 8, the transmission characteristics can be further improved with respect to Scd21 and Sdd21.

For example, in the case of a cable in which a pair of insulated wires are twisted as in the cable disclosed in U.S. Pat. No. 8,981,216, even when the covering resin layer is included similarly to Examples 1 and 2, the value of Scd21 is better in Examples 1 and 2. In addition, the values of Sdd21 in Examples 1 and 2 are better than that of the parallel pair cable in which the pair of insulated wires are twisted. That is, the parallel pair cables 1 and 1A are superior to the parallel pair cable in which the pair of insulated wires are twisted in high frequency transmission characteristics.

Hereinbefore, the invention has been described in detail and with reference to specific embodiments, and it will be apparent to those skilled in the art that various changes and modifications can be made without departing from the spirit and scope of the invention. Further, the number, position, shape, and the like of the constituent members described above are not limited to the above embodiments, and can be changed to a suitable number, position, shape, and the like for implementing the invention.

What is claimed is:

1. A parallel pair cable comprising:

a single pair of insulated wires each of which includes an insulating layer around a conductor;

a covering resin layer which is in contact with the pair of insulated wires, and which covers the pair of insulated wires;

a shield layer which is disposed outside the covering resin layer in contact with the covering resin layer, anti which includes a metal layer, and a pair of drain wires each of which is disposed so as to be in electrical contact with the metal layer of the shield layer and each of which is located outside the shield layer, wherein the pair of insulated wires are in contact with each other and arranged in parallel without being twisted, and the covering resin layer is formed by extrusion of resin, wherein the covering resin layer has a seamless outer peripheral surface and an outline of a cross section of the covering resin layer consists of two circular are portions and two straight line portions connecting the circular arc portions, wherein the pair of drain wires are disposed on a straight line connecting the centers of the pairs of insulated wires with the insulated wires sandwiched therebetween, wherein the covering resin layer covers the insulating layers of the pair of insulated wires without a gap in the pair of insulated wires, and wherein each of the pair of drain wires is in contact with the metal layer which is disposed outside of the circular arc portions of the covering resin layer without being in contact with the single pair of insulated wires.

2. The parallel pair cable according to claim 1, wherein a first resin forming the covering resin layer is different in property from a second resin forming the insulating layers of the pair of insulated wires, the first resin has higher mechanical strength than the second resin, and the second resin has lower dielectric constant than the first resin.

3. The parallel pair cable according to claim 1, further comprising:

an insulating jacket layer which is provided outside the shield layer and the drain wire.

* * * * *